US005518066A

United States Patent [19]

Francis et al.

[11] Patent Number: 5,518,066

[45] Date of Patent: May 21, 1996

[54] HEAT EXCHANGER

[75] Inventors: Dennis G. Francis; Larry C. Brumbaugh; John R. McCutchen, all of Tulsa, Okla.

[73] Assignee: Connell Limited Partnership, Boston, Mass.

[21] Appl. No.: 250,159

[22] Filed: May 27, 1994

[51] Int. Cl.[6] ..... F28F 9/00

[52] U.S. Cl. ..... 165/83; 165/158; 165/DIG. 59; 165/133

[58] Field of Search ..... 165/133, 83, 158

[56] References Cited

U.S. PATENT DOCUMENTS

| | | | |
|---|---|---|---|
| 2,298,511 | 10/1942 | Rathbun . | |
| 3,814,178 | 6/1974 | Parussel | 165/158 |
| 3,948,315 | 4/1976 | Powell . | |
| 3,982,585 | 9/1976 | Gribsvad | 165/83 |
| 4,221,763 | 9/1980 | Greene | 422/197 |
| 4,415,020 | 11/1983 | Daugirda | 165/76 |
| 4,557,322 | 12/1985 | Nipple . | |
| 4,825,942 | 5/1989 | Helberg . | |
| 4,846,262 | 7/1989 | Lawrance et al. . | |
| 4,848,448 | 7/1989 | Kaarre . | |
| 4,852,644 | 8/1989 | Schlemenat et al. | 165/158 |
| 5,101,892 | 4/1992 | Takeuchi et al. . | |
| 5,181,559 | 1/1993 | Svoboda . | |

*Primary Examiner*—Allen J. Flanigan

*Attorney, Agent, or Firm*—R. Anthony Diehl; Steve Mendelsohn; William H. Murray

[57] ABSTRACT

A heat exchanger for use in applications with high temperatures and rapidly changing thermal gradients. The heat exchanger has a shell, a head, a tubesheet, a tubesheet skirt, and a tube bundle. The tubesheet has a peripheral diameter smaller than the inner diameter of the interior of the head and is coupled to the head by the tubesheet skirt. The gap between the tubesheet and the head is sufficient to allow the removal of the tubesheet from the head after the tubesheet suffers typical thermal deformation. In a preferred embodiment, the head defines a chamber having a combined spherical-cylindrical geometry.

26 Claims, 2 Drawing Sheets

HEAT EXCHANGER

BACKGROUND OF THE INVENTION

1. Field of the Invention

The present invention relates to heat exchangers and, in particular, to heat exchangers with removable tubesheets and tube bundles for use in applications involving high temperatures and rapidly changing thermal gradients.

2. Description of the Related Art

A variety of heat exchangers are used in the electric power generation and chemical manufacturing industries. Generally, such heat exchangers comprise a shell, a plurality of tubes (i.e., a tube bundle), a tubesheet, and a head. In operation, steam may be routed through the shell and water may be routed through the tubes. The opposite is also possible. As they pass through the heat exchanger, the steam is cooled and the water is heated.

Heat exchangers employed in the chemical manufacturing industry may be subjected to extremely high temperatures and rapidly changing thermal gradients. For example, the temperature in a heat exchanger employed in a hydrodesulphurization process may go from a normal operating range of about 600–1000 degrees fahrenheit to about 2000 degrees fahrenheit after a hydrogen bubble ignites in the reactor vessel. These elevated temperatures may last as long as three minutes. Such high temperatures and the accompanying thermal gradients may cause thermal stresses that may result in permanent physical deformation and/or cracking of the heat exchanger components.

It is desirable for heat exchangers used in chemical manufacturing applications to withstand high temperatures and rapidly changing thermal gradients without deformation or cracking. In addition, it is desirable for such heat exchangers to permit removal of the tubesheet and the tube bundle for maintenance and/or replacement.

Conventional heat exchangers, however, do not meet these goals. Most conventional heat exchangers do not provide full access to the tubesheet and tube bundle for easy maintenance and/or replacement. Those heat exchangers that do provide for full access to the tubesheet and tube bundle are not designed to withstand the high temperatures encountered in many chemical manufacturing applications.

It is accordingly an object of this invention to overcome the disadvantages and drawbacks of the known art and to provide a heat exchanger with a tubesheet and tube bundle that can be easily removed from the shell for maintenance and/or replacement.

It is a further object of this invention to provide a heat exchanger designed to withstand high temperatures and rapidly changing thermal gradients.

Further objects and advantages of this invention will become apparent from the detailed description of a preferred embodiment which follows.

SUMMARY OF THE INVENTION

The present invention is directed to a heat exchanger comprising a shell, a head having an inner surface, a tubesheet having a peripheral surface, a tubesheet skirt, and a tube bundle connected to the tubesheet. The head is attached to the shell and the tubesheet is positioned within the head to define a gap between the peripheral surface of the tubesheet and the inner surface of the head. In addition, the tubesheet skirt couples the tubesheet to the head.

The present invention is also directed to a head assembly for a heat exchanger having a shell, a tubesheet, and a tube bundle connected to the tubesheet. The head assembly comprises a head having an inner surface and a tubesheet skirt. The head is attached to the shell and the tubesheet is positioned within the head to define a gap between the peripheral surface of the tubesheet and the inner surface of the head. In addition, the tubesheet skirt couples the tubesheet to the head.

BRIEF DESCRIPTION OF THE DRAWINGS

Other objects, features, and advantages of the present invention will become more fully apparent from the following detailed description of the preferred embodiments, the appended claims, and the accompanying drawings in which:

DESCRIPTION OF THE PREFERRED EMBODIMENTS

The disclosure of U.S. Pat. No. 4,846,262 ("the '262 patent") is incorporated herein by reference. The head closure member described in the '262 patent is substantially equivalent to the head in this specification. The end-cover described in the '262 patent is substantially equivalent to the channel cover described in this specification. The closure chamber described in the '262 patent is substantially equivalent to the channel described in the present specification.

The present invention relates to heat exchangers, and, in particular, to heat exchangers for use in processes involving high temperatures and rapidly changing thermal gradients. In particular, a heat exchanger according to the present invention is highly resistant to damage caused by thermal stress. In addition, the tubesheet and tube bundle in a heat exchanger according to the present invention can be easily removed even if the tubesheet has suffered permanent thermal deformation.

Figure 1:
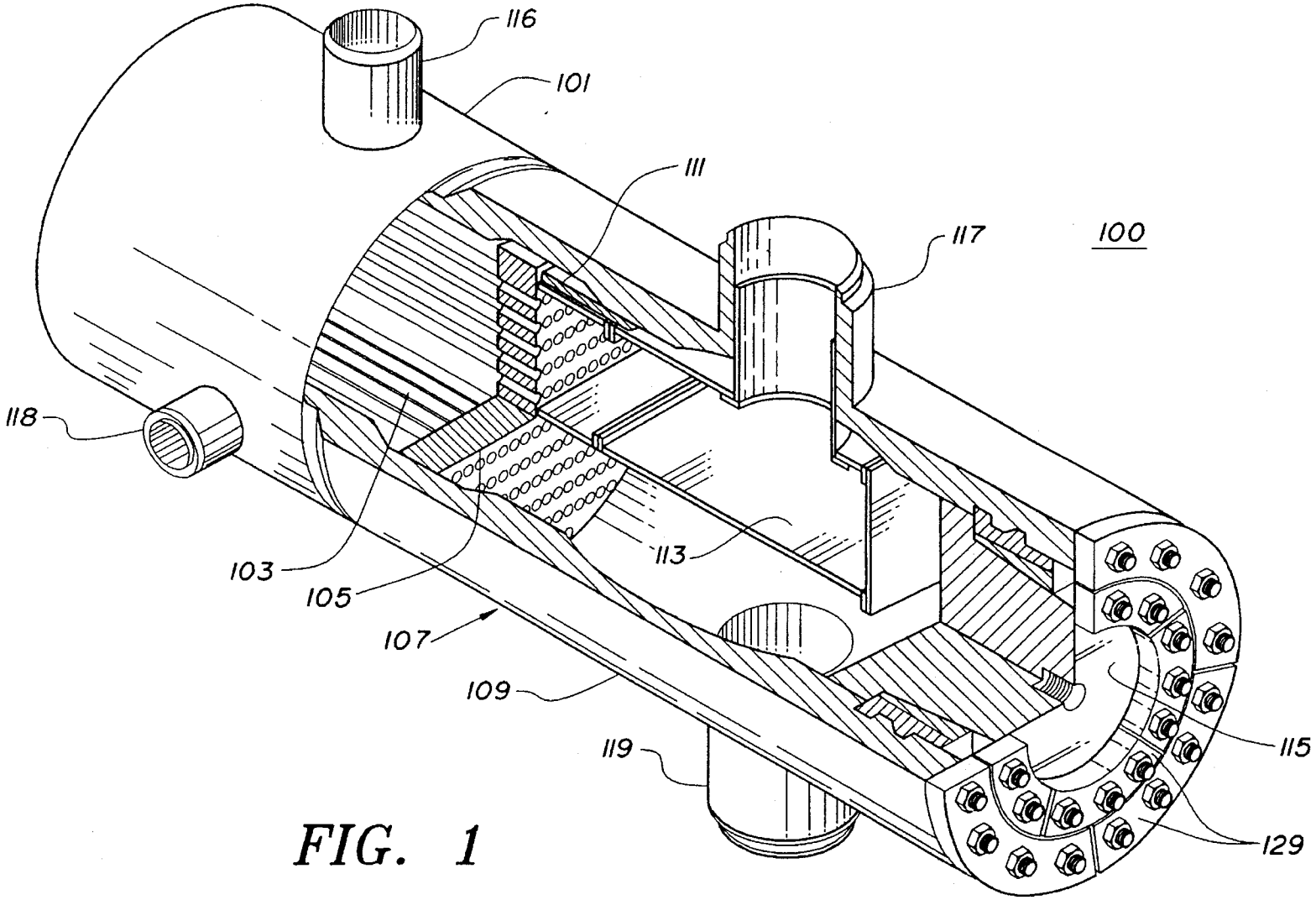
FIG. 1 shows a perspective partial cutaway view of a heat exchanger according to a preferred embodiment of the present invention.

Referring now to FIG. 1, there is shown a heat exchanger 100 corresponding to a preferred embodiment of the present invention. Heat exchanger 100 comprises a shell 101, a tube bundle 103, a tubesheet 105, and a head assembly 107. The head assembly 107 comprises a head 109, a tubesheet skirt 111, a pass partition box 113, a channel cover 115 with fastening means, feedwater inlet 119, and feedwater outlet 117.

In operation, feedwater (or other fluid) is fed into the feedwater inlet 119 on the head assembly 107, while steam (or other relatively hot fluid) is fed into the steam inlet 116 on the shell. The feedwater is directed through the tubesheet 105 and into the tubes 103 by the pass partition box 113. While passing through the tubes 103, the feedwater cools the steam in the surrounding shell 101. The steam condenses and drains from the shell through the drain outlet 118. The feedwater passes back through the tubesheet 105 into the other half of the head assembly 107 and out of the heat exchanger 100 through the feedwater outlet 117.

Figure 2:
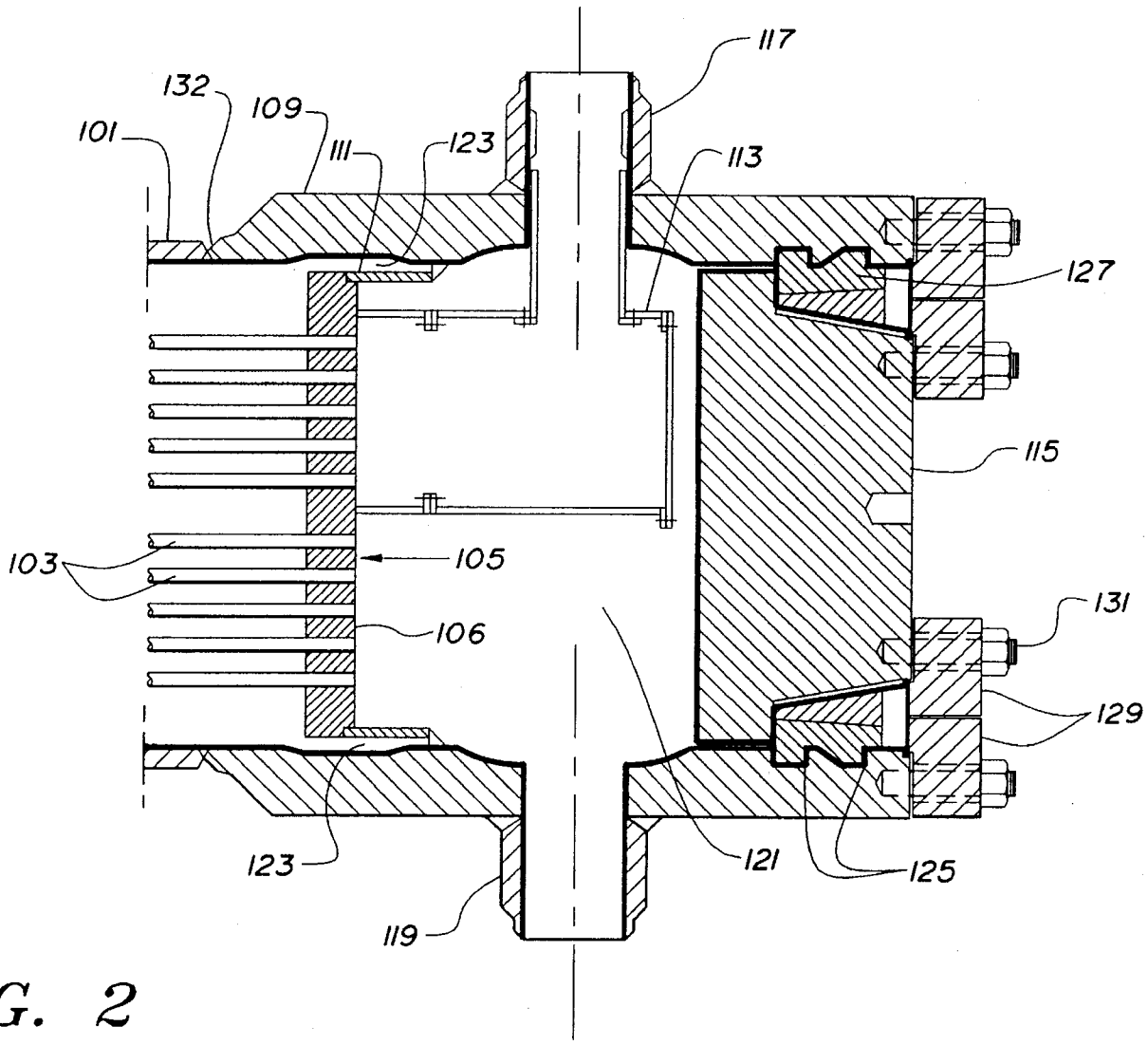
FIG. 2 shows a cross-sectional side view of the head assembly of the heat exchanger of FIG. 1.

Referring now to FIG. 2, there is shown a cross-sectional side view of head assembly 107 of heat exchanger 100 of FIG. 1, according to a preferred embodiment of the present invention. The head 109 is preferably a single piece of forged steel that may be welded to the shell at 132. In an alternative preferred embodiment (not shown), the head 109 may form an integral part of the shell 101. The end of the head 109 that is attached to the shell 101 is called the proximal end. The other end of the head 109 is called the distal end. The head 109 preferably defines a channel 121 with a mixed cylindrical-spherical geometry as described in the '262 patent. In addition, an annular recess 123 is formed near the proximal end of the head 109. The head 109 also has a feedwater inlet 119 and a feedwater outlet 117. In addition, the head is formed to define a plurality of annular grooves 125 in the distal end of the head 109. This configuration of annular grooves 125 is described in the '262 patent and will be referred to hereafter as vertical-sloped annular grooves 125.

The tubesheet 105 is positioned adjacent to the annular recess 123 in the head. The tubesheet 105 has a peripheral diameter smaller than the inner diameter of the head 109 in the region of the annular recess 123. There is, therefore, a gap between the peripheral surface of the tubesheet 105 and the inner surface of the head 109. This gap is great enough to allow removal of the tubesheet 105 and the tube bundle 103 from the head 109 even when the tubesheet 105 has suffered typical thermal deformation. In addition, the peripheral diameter of the tubesheet 105 is sufficiently less than the inner diameter of the opening at the distal end of the head 109 to permit the removal of the tubesheet 105 and tube bundle 103 for maintenance and/or replacement.

The tubesheet 105 is coupled to the head 109 by a tubesheet skirt 111. The tubesheet skirt 111 is preferably a single cylindrical piece having approximately the same peripheral diameter as the tubesheet 105. One end of the tubesheet skirt 111 is welded to the tubesheet 105, and the other end is welded to the head 109. The tubesheet skirt 111 is preferably welded to the head 109 using a full fillet weld. The welded tubesheet skirt 111 separates the interior of the shell 101 from the head channel 121.

The pass partition box 113 is positioned in the head 109 and welded to the tubesheet 105 so as to separate the incoming feedwater from the outgoing feedwater. The pass partition box 113 also serves as a thermal barrier between the cooler incoming feedwater and the warmer outgoing feedwater. The pass partition box 113 is preferably free floating with a cantilever design known to those skilled in the art. The cantilever design allows for thermal expansion radially and longitudinally.

The channel cover 115 is removably disposed within the cylindrically-shaped distal end of the head 109 and is fastened to the head 109 by a plurality of annular retaining key segments 127. The retaining key segments 127 are held in place by a plurality of bolting rings 129 and bolts 131. The annular retaining keys 127 are generally as described in the '262 patent and will be referred to hereafter as vertical-sloped annular retaining keys 127. A seal between the bolting rings 129 and the channel cover 115 is provided by a spiral wound gasket 135 or similar self-energizing sealing means. The spiral wound gasket 135 is self-energizing and is designed to accommodate movement and flexure of the channel cover 115, vertical-sloped annular retaining keys 127, and head 109 caused by thermal deformation and expansion. The bolting rings 129 and bolts 131 fasten the annular retaining keys 127 in place. The bolting rings 129 have a plurality of holes therethrough for receiving the bolts. The holes in the bolting ring for receiving the bolts 131 have a diameter greater than the diameter of the bolts 131 to allow for thermal expansion of the bolts 131. In addition, each bolting ring is preferably cut into two or more circumferential segments (as shown in FIG. 1) such that, when each bolting ring 129 is secured to the head 109, there are gaps between adjacent ends of the segments of each bolting ring 129 to allow for thermal expansion.

In a preferred embodiment of the present invention, a stainless steel weld overlay 137 (shown as a heavy black line in FIG. 2) is applied over the exposed surfaces in the head. The weld overlay acts as a hydrogen barrier and prevents embrittlement and corrosion of the low alloy steel. The weld overlay is preferably 0.25 inch thick.

In a preferred embodiment of the present invention, the head 109, the tubesheet 105, the tubesheet skirt 111, the channel cover 115, the bolting rings 129, and the bolts 131 are preferably made of low alloy steel comprising approximately 2.25 parts chrome to 1 part molydbendum. The vertical-sloped annular retaining keys 127 of the present invention are made of stainless steel so that they are resistant to embrittlement and corrosion. 321 stainless steel is preferred. Both the low alloy steel and the stainless steel have been found to be suitable for applications involving high temperatures and rapid thermal cycling because of their resistance to permanent deformation and cracking.

In a preferred embodiment of the present invention, the vertical-sloped annular retaining keys 127 are smaller than the annular grooves 125 to allow for thermal expansion. Radial gap springs (not shown) are disposed with the vertical-sloped annular retaining keys 127. The radial gap springs are positioned to force the vertical-sloped annular retaining keys 127 into the vertical-sloped grooves 125.

The present invention may be embodied in other specific forms without departing from the spirit or essential attributes of the invention. For example, in an alternative embodiment of the present invention, the tubesheet 105 may have a ceramic coating 106 to provide insulation for the tubesheet 105 that minimizes thermal deformation and cracking of the tubesheet 105.

In another alternative embodiment of the present invention, the head 109 does not have annular recess 123. In this embodiment, the tubesheet skirt may have a conical shape.

It will be further understood that various other changes in the details, materials, and arrangements of the parts which have been described and illustrated in order to explain the nature of this invention may be made by those skilled in the art without departing from the principle and scope of the invention as expressed in the following claims.

What is claimed is:

1. A heat exchanger, comprising:

(a) a shell;

(b) a head having an inner surface;

(c) a tubesheet having a peripheral surface;

(d) a tubesheet skirt; and (e) a tube bundle connected to the tubesheet, wherein:

the head is attached to the shell;

the head defines a channel with a recess:

the tubesheet is positioned within the head adjacent to the recess to define a gap between the peripheral surface of the tubesheet and the inner surface of the head; and the tubesheet skirt couples the tubesheet to the head.

2. The heat exchanger of claim 1, wherein the head is welded to the shell.

3. The heat exchanger of claim 1, wherein the tubesheet skirt is welded to the head and the tubesheet.

4. The heat exchanger of claim 1, wherein the tubesheet skirt is cylindrical.

5. The heat exchanger of claim 1, wherein the head defines a channel with a combined spherical-cylindrical geometry.

6. The head assembly of claim 1, further comprising:

(f) a channel cover; and (g) vertical-sloped annular retaining keys, wherein: the head has a distal end;

the channel cover is removably disposed within the distal end of the head;

the head defines vertical-sloped annular grooves in the distal end of the head; and the vertical-sloped annular retaining keys are removably nested in the annular vertical-sloped grooves.

7. The heat exchanger of claim 6, wherein the vertical-sloped annular retaining keys are made of stainless steel.

8. The heat exchanger of claim 6, further comprising:

(h) a bolting ring having a plurality of holes therethrough for receiving a plurality of bolts, wherein:

the bolts and the bolting ring removably fasten the channel cover to the head.

9. The heat exchanger of claim 8, wherein the holes in the bolting ring have a diameter sufficiently greater than the diameter of the bolts to allow for thermal expansion.

10. The heat exchanger of claim 9, wherein the bolting ring is divided into a plurality of segments, and there is a thermal expansion gap between the ends of adjacent segments of the bolting ring when the bolting ring is installed on the head.

11. The heat exchanger of claim 6, wherein the vertical-sloped annular retaining keys are smaller than the vertical-sloped annular grooves to allow room for thermal expansion of the vertical-sloped annular retaining keys.

12. The heat exchanger of claim 1, wherein the tubesheet has a ceramic coating.

13. A heat exchanger, comprising:

(a) a shell;

(b) a head having an inner surface;

(c) a tubesheet having a peripheral surface;

(d) a tubesheet skirt;

(e) a tube bundle connected to the tubesheet;

(f) a channel cover;

(g) vertical-sloped annular retaining keys;

(h) a bolting ring having a plurality of holes therethrough for receiving a plurality of bolts, wherein:

the head is welded to the shell;

the tubesheet is positioned within the head to define a gap between the peripheral surface of the tubesheet and the inner surface of the head;

the tubesheet skirt is welded to the head and the tubesheet:

the head defines a channel with a recess;

the tubesheet is positioned adjacent to the recess;

the tubesheet skirt is cylindrical;

the head defines a channel with a combined spherical-cylindrical geometry;

the head has a distal end;

the channel cover is removably disposed within the distal end of the head;

the head defines vertical-sloped annular grooves in the distal end of the head;

the vertical-sloped annular retaining keys are removably nested in the annular vertical-sloped grooves;

the vertical-sloped annular retaining keys are made of stainless steel;

the bolts and the bolting ring removably fasten the channel cover to the head;

the holes in the bolting ring have a diameter sufficiently greater than the diameter of the bolts to allow for thermal expansion;

the bolting ring is divided into a plurality of segments, and there is a thermal expansion gap between the ends of adjacent segments of the bolting ring when the bolting ring is installed on the head;

the vertical-sloped annular retaining keys are smaller than the vertical-sloped annular grooves to allow room for thermal expansion of the vertical-sloped annular retaining keys; and the tubesheet has a ceramic coating.

14. A head assembly for a heat exchanger having a shell, a tubesheet, and a tube bundle connected to the tubesheet, comprising:

(a) a head having an inner surface; and (b) a tubesheet skirt, wherein:

the head is adapted to be attached to the shell;

the head defines a channel with a recess adapted to receive the tubesheet within the head adjacent, to the recess so as to define a gap between the peripheral surface of the tubesheet and the inner surface of the head; and the tubesheet skirt is coupled to the head and is adapted to couple the tubesheet to the head such that the tubesheet is positioned adjacent to the recess so as to define a gap between the peripheral surface of the tubesheet and the inner surface of the head.

15. The head assembly of claim 14, wherein the head is adapted to be welded to the shell.

16. The head assembly of claim 14, wherein the tubesheet skirt is welded to the head and is adapted to be welded to the tubesheet.

17. The head assembly of claim 14, wherein the tubesheet skirt is cylindrical.

18. The head assembly of claim 14, wherein the head defines a channel with a combined spherical-cylindrical geometry.

19. The head assembly of claim 14, further comprising:

(c) a channel cover; and (d) vertical-sloped annular retaining keys, wherein:

the head has a distal end;

the channel cover is removably disposed within the distal end of the head;

the head defines vertical-sloped annular grooves in the distal end of the head; and the vertical-sloped annular retaining keys are removably nested in the annular vertical-sloped grooves.

20. The head assembly of claim 19, wherein the vertical-sloped annular retaining keys are made of stainless steel.

21. The head assembly of claim 19, further comprising:

(e) a bolting ring having a plurality of holes therethrough for receiving a plurality of bolts, wherein:

the bolts and the bolting ring removably fasten the channel cover to the head.

22. The head assembly of claim 21, wherein the holes in the bolting ring have a diameter sufficiently greater than the diameter of the bolts to allow for thermal expansion.

23. The head assembly claim 21, wherein the bolting ring is divided into a plurality of segments, and there is a thermal expansion gap between the ends of adjacent segments of the bolting ring when the bolting ring is installed on the head.

24. The head assembly of claim 19, wherein the vertical-sloped annular retaining keys are smaller than the vertical-sloped annular grooves to allow room for thermal expansion of the vertical-sloped annular retaining keys.

25. The head assembly of claim 14, wherein the tubesheet has a ceramic coating.

26. A head assembly for a heat exchanger having a shell, a tubesheet, and a tube bundle connected to the tubesheet, comprising:

(a) a head having an inner surface;

(b) a tubesheet skirt;

(c) a channel cover;

(d) vertical-sloped annular retaining keys;

(e) a bolting ring having a plurality of holes therethrough for receiving a plurality of bolts, wherein:

the head is adapted to be welded to the shell:

the head defines a channel with a recess adapted to receive the tubesheet within the head adjacent to the recess so as to define a gap between the peripheral surface of the tubesheet and the inner surface of the head;

the tubesheet skirt is welded to the head and is adapted to couple the tubesheet to the head such that the tubesheet is positioned adjacent to the recess so as to define a gap between the peripheral surface of the tubesheet and the inner surface of the head;

the tubesheet skirt is cylindrical;

the head defines a channel with a combined spherical-cylindrical geometry;

the head has a distal end;

the channel cover is removably disposed within the distal end of the head;

the head defines vertical-sloped annular grooves in the distal end of the head;

the vertical-sloped annular retaining keys are removably nested in the annular vertical-sloped grooves;

the vertical-sloped annular retaining keys are made of stainless steel;

the bolts and the bolting ring removably fasten the channel cover to the head;

the spiral wound gasket provides a seal between the bolting ring and the channel cover;

the holes in the bolting ring have a diameter sufficiently greater than the diameter of the bolts to allow for thermal expansion;

the bolting ring is divided into a plurality of segments, and there is a gap between the ends of adjacent segments of the bolting ring when the bolting ring is installed on the head;

the vertical-sloped annular retaining keys are smaller than the vertical-sloped annular grooves to allow room for thermal expansion of the vertical-sloped annular retaining keys; and the tubesheet has a ceramic coating.

* * * * *